United States Patent [19]

McNeil et al.

[11] Patent Number: 4,525,939

[45] Date of Patent: Jul. 2, 1985

[54] BOOT SAFETY ATTACHMENT

[76] Inventors: Reginald K. McNeil; George Spector, both of 233 Broadway, RM 3615, New York, N.Y. 10007

[21] Appl. No.: 544,844

[22] Filed: Oct. 24, 1983

[51] Int. Cl.[3] ..... A43B 5/00

[52] U.S. Cl. ..... 36/7.6; 36/62; 36/114; 36/132

[58] Field of Search ..... 36/7.6, 7.7, 7.5, 62, 36/114, 124, 67 D, 66, 132

[56] References Cited

U.S. PATENT DOCUMENTS

| | | | |
|---|---|---|---|
| 508,328 | 11/1893 | Loyd | 36/7.6 |
| 1,868,729 | 7/1932 | Crap | 36/7.6 |
| 2,189,489 | 2/1940 | Fritz | 36/7.6 |
| 2,189,884 | 2/1940 | Dow | 36/7.6 |
| 2,193,943 | 3/1940 | Shea | 36/7.6 |
| 3,229,389 | 1/1966 | Adams | 36/7.6 |

*Primary Examiner*—Werner H. Schroeder
*Assistant Examiner*—Mary A. Ellis

[57] ABSTRACT

A non-slipping attachment for a boot, shoe, sneaker and the like is provided and consists of a toe portion, a heel portion and a resilient center bridge for stretchably connecting the toe and heel portions. Both the toe and heel portions have a plurality of downwardly disposed ground gripping spikes. Another design has adjustable spikes for raising the footwear to different heights.

3 Claims, 6 Drawing Figures

BOOT SAFETY ATTACHMENT

BACKGROUND OF THE INVENTION

The instant invention relates generally to safety devices for footwear and more specifically it relates to a non-slipping attachment for a boot, shoe, sneaker and the like.

In the winter a person wearing boots can slip on ice, snow and slush. In the summer a person wearing shoes or sneakers can slip on wet grass when walking or playing sports, such as football, track, golf, etc. This situation is dangerous so accordingly it is in need of an improvement.

Numerous safety devices for footwear have been provided in prior art that are adapted to prevent slipping. For example, U.S. Pat. Nos. 3,229,389; 3,949,495 and 4,299,037 all are illustrative of such prior art. While these units may be suitable for the particular purpose to which they address, they would not be suitable for the purpose of the present invention as heretofore described.

SUMMARY OF THE INVENTION

A principle object of the present invention is to provide a non-slipping attachment for a boot, shoe, sneaker and the like that can be used on ice, snow and slush in the winter and on wet grass in the summer.

Another object is to provide a non-slipping attachment for a boot, shoe, sneaker and the like that can easily fit on various size footwear.

An additional object is to provide a non-slipping attachment for a boot, shoe, sneaker and the like that has adjustable spikes for raising the footwear to different heights.

A further object is to provide a non-slipping attachment for a boot, shoe, sneaker and the like that is simple and easy to use.

A still further object is to provide a non-slipping attachment for a boot, shoe, sneaker and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
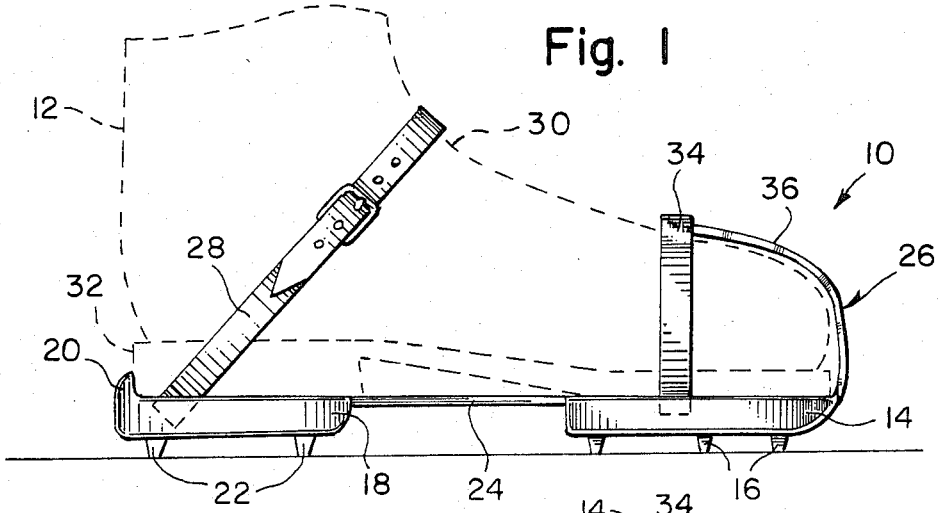
FIG. 1 is a side elevation view of the invention shown attached to a shoe.
Figure 2:
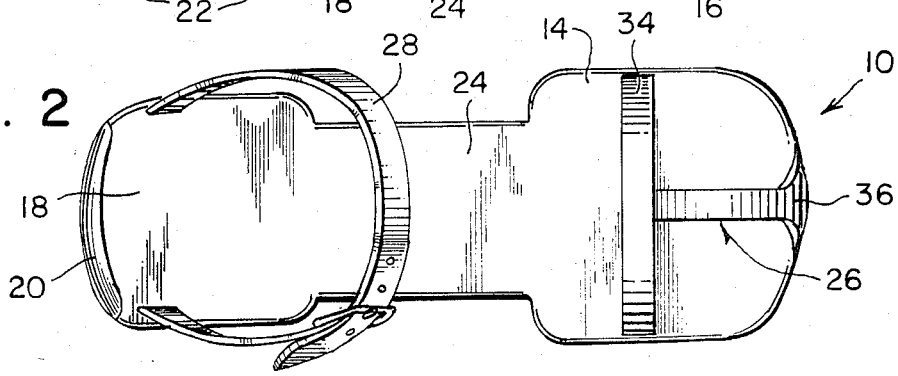
FIG. 2 is a top view of the invention thereof.
Figure 3:
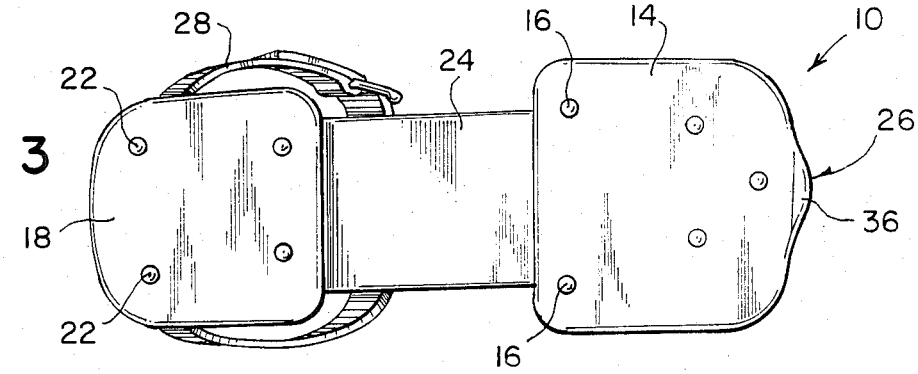
FIG. 3 is a bottom view thereof.

Turning now descriptively to the drawings, in which similar reference characters denote similar elements throughout the several views, FIGS. 1 through 3 illustrates a non-slipping attachment 10 for a boot, shoe, sneaker and the like 12. The attachment 10 consists of a toe portion 14 that has a plurality of downwardly disposed ground gripping spikes 16, a heel portion 18 that has an upstanding rear heel engaging flange 20 and a plurality of downwardly disposed ground gripping spikes 22, a resiliently stretchable center bridge 24 made of plastic or rubber secured between the toe portions 14 and the heel portion 18, a flexible toe surrounding member 26 attached to the toe portion 14 and an adjustable strap 28 attached to the heel portion 18 and across an instep 30 for detachable securing the upstanding rear heel engaging flange 20 to rear of a heel 32 of the boot, shoe, sneaker and the like 12.

The flexible toe surrounding member 26 consists of a vamp strap member 34 attached to the toe portion 14 and a tip strap member 36 attached between the toe portion 14 and the vamp strap member 34 form a T-shaped configuration.

Figure 4:
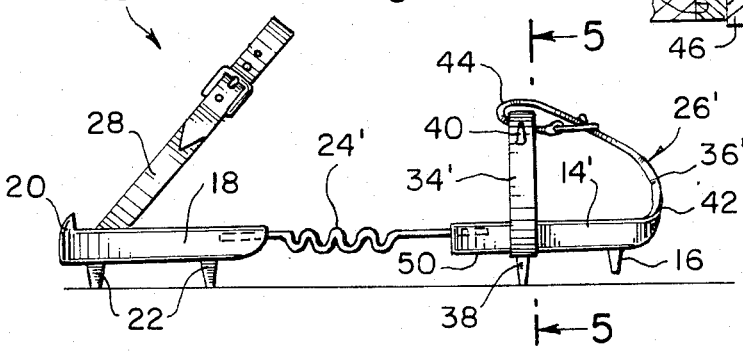
FIG. 4 is a side view of another design of the invention which includes a center bridge made of corrugated spring steel so to be adjustable to different sizes of shoes.
Figure 5:
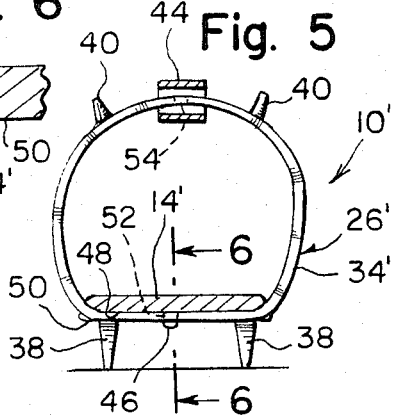
FIG. 5 is a cross sectional view on line 5—5 of FIG. 4 and showing still another design having adjustable spikes for raising the shoe to different heights.

FIGS. 4 and 5 illustrates a modified non-slipping attachment 10'. The flexible toe surrounding member 26' consists of a vamp ring strap member 34' having a first pair of outwardly disposed spikes 38 of one size and a second pair of outwardly disposed spikes 40 of another size opposite the first pair outwardly disposed spikes 38. A tip strap member 36' has one side 42 attached to the toe portion 14' while other side contains a detachable loop portion 44 attached to the vamp ring strap member 34'. When the detachable loop portion 44 is opened the vamp ring strap member 34' can be turned trnsversely around the toe portion 14' whereby the spikes 38 and 40 can be changed for raising and lowering the toe portion 14'.

Figure 6:
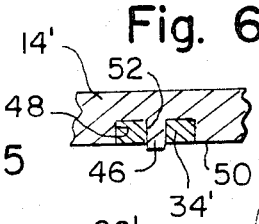
FIG. 6 is an enlarged cross sectional view on line 6—6 of FIG. 5.

As best seen in FIG. 6 a pin 46 is affixed downwardly from a center of a transverse slot 48 in bottom 50 of the toe portion 14'. The vamp ring strap member 34' has a first aperture 52 between the first pair of outwardly disposed spikes 38 and a second aperture 54 opposite the first aperture 52 and between the second pair of outwardly disposed spikes 40. When the vamp ring strap members 34' is turned one of the apertures 52, 54 will engage the pin 46 in the transverse slot 48 locking the vamp ring strap member 34' in position.

In FIG. 4 the resiliently stretchable center bridge 24' is made of corrugated spring steel so as to be adjustable to different sizes of footwear.

While certain novel features of this invention have been shown and described and are pointed out in the annexed claims, it will be understood that various omissions, substitutions and changes in the forms and deails of the device illustrated and in its operation can be made by those skilled in the art without departing from the spirit of the invention.

What is claimed is:

1. A non-slipping attachment for a boot, shoe, sneaker and the like comprising:

(a) a toe portion having a plurality of downwardly disposed fround gripping spikes;

(b) a heel portion having an upstanding rear heel engaging flange and a plurality of downwardly disposed ground gripping spikes;

(c) a resiliently stretchable center bridge secured between the toe portion and the heel portion;

(d) a flexible toe surrounding member attached to the toe portion; and (e) an adjustable strap attached to the heel portion and across an instep for detachably securing the upstanding rear heel engaging flange to rear of a heel of the boot, shoe, sneaker and the like, wherein the flexible toe surrounding member comprises:

(a) a vamp ring strap member having a first pair of outwardly disposed spikes of one size and a second pair of outwardly disposed spikes of another size opposite the first pair of outwardly disposed spikes; and (b) a tip strap member having one side attached to the toe portion while the other side contains a detachable loop portion attached to the vamp ring strap member so that when the detachable loop portion is opened the vamp ring strap member can be turned transversely around the toe portion whereby the spikes can be changed for raising and lowering the toe portion.

2. The non-slipping attachment as recited in claim 1, wherein the flexible toe surrounding member further comprises:

(a) a pin affixed downwardly from a center of a transverse slot in bottom of the toe portion; and (b) the vamp ring strap member havong a first aperture between the first pair of outwardly disposed spikes and a second aperture opposite the first aperture and between the second pair of outwardly disposed spikes so that when the vamp ring strap member is turned one of the apertures will engage the pin in the transverse slot locking the vamp ring strap member in position.

3. The non-slipping attachment as recited in claim 2, wherein the resiliently stretchable center bridge is made of corrugated spring steel so as to be adjustable to different sizes of footwear.

* * * * *